US006431992B1

(12) United States Patent
Moody

(10) Patent No.: US 6,431,992 B1
(45) Date of Patent: Aug. 13, 2002

(54) GOLF SWING TRAINING CLUB

(76) Inventor: Richard H. Moody, 238 Drain Rd., Fyffe, AL (US) 35971

( * ) Notice: Subject to any disclaimer, the term of this patent is extended or adjusted under 35 U.S.C. 154(b) by 0 days.

(21) Appl. No.: 09/907,858

(22) Filed: Jul. 18, 2001

(51) Int. Cl.[7] ..... A63B 69/36
(52) U.S. Cl. ..... 473/230; 473/232; 473/257
(58) Field of Search ..... 473/232, 233, 473/230, 231, 223, 219, 226, 257, 242; D21/733, 734

(56) References Cited

U.S. PATENT DOCUMENTS

| | | | | |
|---|---|---|---|---|
| 2,223,647 | A | | 12/1940 | Stumpf |
| 2,255,332 | A | * | 9/1941 | Russell |
| 2,300,043 | A | * | 10/1942 | Carney |
| 2,708,579 | A | * | 5/1955 | Hugman |
| 3,033,575 | A | | 5/1962 | Hause |
| 3,044,781 | A | * | 7/1962 | Murphy |
| 3,606,340 | A | | 9/1971 | Tiller |
| 3,680,868 | A | * | 8/1972 | Jacob |
| 4,756,535 | A | * | 7/1988 | Bradley |
| 4,854,585 | A | | 8/1989 | Koch et al. |
| 5,205,561 | A | | 4/1993 | Lux |
| 5,236,192 | A | | 8/1993 | Pitzel |
| 5,277,427 | A | | 1/1994 | Bryan et al. |
| 5,370,396 | A | | 12/1994 | Bloom |
| 5,454,568 | A | | 10/1995 | Richardson |
| 5,489,100 | A | | 2/1996 | Potter |
| 6,007,341 | A | | 12/1999 | Koch |

FOREIGN PATENT DOCUMENTS

| | | |
|---|---|---|
| GB | 5902 | * of 1894 |
| GB | 11463 | * of 1902 |

* cited by examiner

*Primary Examiner*—Sebastiano Passaniti
(74) *Attorney, Agent, or Firm*—Waddey & Patterson; Larry W. Brantley

(57) ABSTRACT

A golf swing training club that trains a golfer to square more accurately the golf club face during the swing for improving the golfer's swing and golf game. The golf swing training club generally comprises a shaft, a cylinder or clicker, and a roller ball to practice precise contact. The hinged club head is adapted to make a clicking noise when it breaks down to indicate an improper swing tempo. The roller ball spins when the club face is squared at the time of impact. Swing practice with the training club of the present invention trains a golfer to develop a slower, more fluid, motion swing to thus achieve and maintain a truer swing plane for consistently making contact with a golf ball when playing golf. The spinning roller ball also allows a golfer to practice keeping his head down and his eyes on the target point. The training club of the present invention can be used by both right handed and left handed golfers. With a proper grip and a limited knowledge of the other fundamentals of the game of golf, the swing training club teaches a golfer to lower his scores while actually playing golf. Spring tension in the breaking club head can be readily adjusted to effect the breaking down of the club head as the golfer's swing develops.

17 Claims, 2 Drawing Sheets

GOLF SWING TRAINING CLUB

FIELD OF THE INVENTION

This invention relates generally to a training device for improving a golfer's golf game, and more particularly to a device that trains a golfer to square more accurately the golf club face during the swing for improving the golfer's swing and golf game.

BACKGROUND OF THE INVENTION

One of the most basic and difficult aspects of golf is the development of a proper golf swing to achieve an accurate and powerful shot that sends the ball a proper distance in a straight line towards the hole in the green. A desired golf swing is generally smooth with the golf club remaining in a constant plane throughout the swing. The golf club should be taken away from the ball at a smooth, even tempo to the top of the backswing. The downswing follows the backswing with the club staying in the same plane as in the backswing with the club head being smoothly accelerated through impact with a golf ball.

While the proper golf swing is relatively simple to describe and visualize, it is very difficult for many golfer's to achieve. Consequently, there is a real need for training devices for improving a golfer's swing.

The prior art abounds with devices for training a golfer to develop a proper swing of golf clubs. Numerous such prior art golf swing training devices are disclosed in United States patents as exemplified by U.S. Pat. No. 3,033,575 to Hause; U.S. Pat. No. 3,606,340 to Tiller; U.S. Pat. No. 4,854,585 to Koch et al.; U.S. Pat. No. 5,205,561 to Lux; U.S. Pat. No. 5,277,427 to Bryan et al.; U.S. Pat. No. 5,370,396 to Bloom; U.S. Pat. No. 5,454,568 to Richardson; U.S. Pat. No. 5,489,100 to Potter; and U.S. Pat. No. 6,007,341 to Koch.

U.S. Pat. No. 3,033,575 discloses a practice golf club having a hinge interposed in its shaft which permits the head of the club to pivot relative to the grip when the club is improperly swung but operates to keep the shaft rigid and straight when the club is swung properly. U.S. Pat. No. 3,606,340 discloses a practice golf club having a head structure that is dynamically responsive to the nature of the swing movement to signal certain swing characteristics to the player through the feel and sight of that dynamic action. U.S. Pat. No. 4,854,585 discloses a golf club swing training device having a hinge mechanism interposed on the shaft adjacent to the club head. The hinge mechanism includes a female member having yoke portions which permit two-way movement of a male member and an adjusting screw which corporates with a biasing spring and generally spherical member to adjust the force necessary to break or articulate the hinge mechanism. U.S. Pat. No. 5,205,561 discloses a golf club swing training device in which the head of the club is hinged to the shaft such that the head breaks or pivots with respect to the shaft when, during the swing, the club does not follow a prescribed path of travel or the club is improperly rotated. U.S. Pat. No. 5,277,427 discloses a golf club training club including a hinge interposed on the shaft adjacent to the head of the club which allows the shaft to articulate when the club is swung improperly. U.S. Pat. No. 5,370,396 discloses a golf club swing training device including a hinge mechanism adjacent to the club head which is adapted to pivot when the club is swung improperly. U.S. Pat. No. 5,454,568 discloses a golf club swing training device including a hinge interposed within the shaft which is adapted to break the hinge if the swing is improper. U.S. Pat. No. 5,489,100 discloses a golf club swing training device including a spring loaded hinge interposed in the shaft of the club which breaks when the swing is improper. U.S. Pat. No. 6,007,341 discloses a golf club swing training device having a hinge mechanism interposed in the shaft of the club which breaks or articulates when the device is swung improperly to indicate a defect in the swing.

While there are numerous devices for training a golfer to improve his swing and golf game in the prior art, including those disclosed in the above-identified United States patents, many are complex and suffer from numerous deficiencies and disadvantages. The present invention overcomes these deficiencies and disadvantages in that it provides an improved golf swing training club that fills the need for a simple, inexpensive, golf swing training club which can be used by both right handed and left handed golfers.

SUMMARY OF THE INVENTION

In accordance with the present invention, there is provided a practice club that trains a golfer to square more accurately the golf club face during the swing for improving the golfer's swing and golf game. The golf swing training club generally comprises a shaft, a cylinder or a clicker secured to the shaft, a club head hingedly secured to the cylinder or clicker, and a roller ball to practice precise contact. The hinged club head is adapted to make a clicking noise when it breaks down to indicate an improper swing tempo. The roller ball spins when the club face is squared at the time of impact. Swing practice with the training club of the present invention trains a golfer to develop a slower, more fluid, motion swing to thus achieve and maintain a truer swing plane for consistently making contact with a golf ball when playing golf. The spinning roller ball also allows a golfer to practice keeping his head down and his eyes on the target point. The training club of the present invention can be used by both right handed golfers and left handed golfers. The drawings illustrate a right handed golfer using the training club of the present invention. With a proper grip and a limited knowledge of the other fundamentals of the game of golf, the present invention teaches a golfer to lower his scores while actually playing golf. Spring tension in the breaking club head can be readily adjusted to effect the breaking down of the club head as the golfer's swing develops.

There is a real need for a simple and inexpensive golf swing training club that will enable a golfer to improve his golf game. The adjustable golf swing training club of the present invention fulfills these needs.

Accordingly, it is an object of the present invention to provide a simple and relatively inexpensive golf swing training club which includes a hinge mechanism that permits the club head to break with respect to the shaft when, during a golf swing, the club is moving too fast, moves through an incorrect arc, or is subject to a jerking or other unusual motion.

It is a further object of the present invention to provide a simple and inexpensive golf swing training club which includes an adjustable hinge mechanism that permits the club head to break with respect to its shaft during an improper golf swing.

These objects as well as other objects and advantages of the present invention will become more readily apparent from the following description taken in conjunction with the accompanying drawings.

DESCRIPTION OF THE PREFERRED EMBODIMENTS

Figure 1:
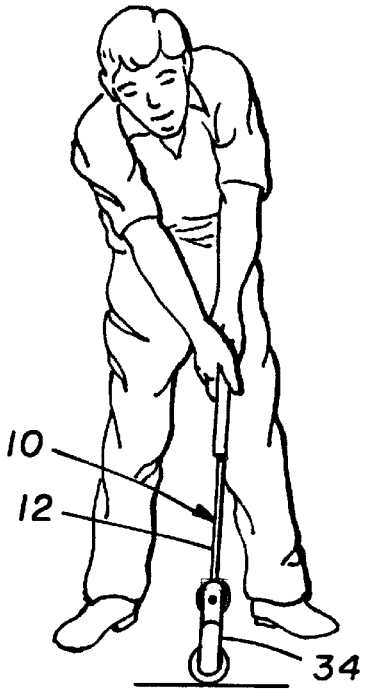
FIG. 1 is a front elevational view of a right-handed golfer holding the golf swing training club of the present invention.
Figure 2:
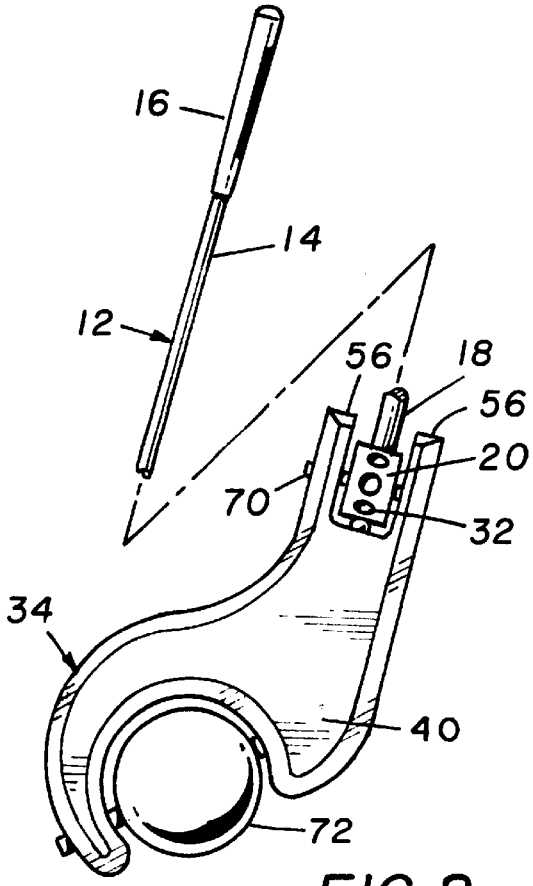
FIG. 2 is a front elevational, partially broken away, view of the golf swing training club of the present invention.
Figure 3:
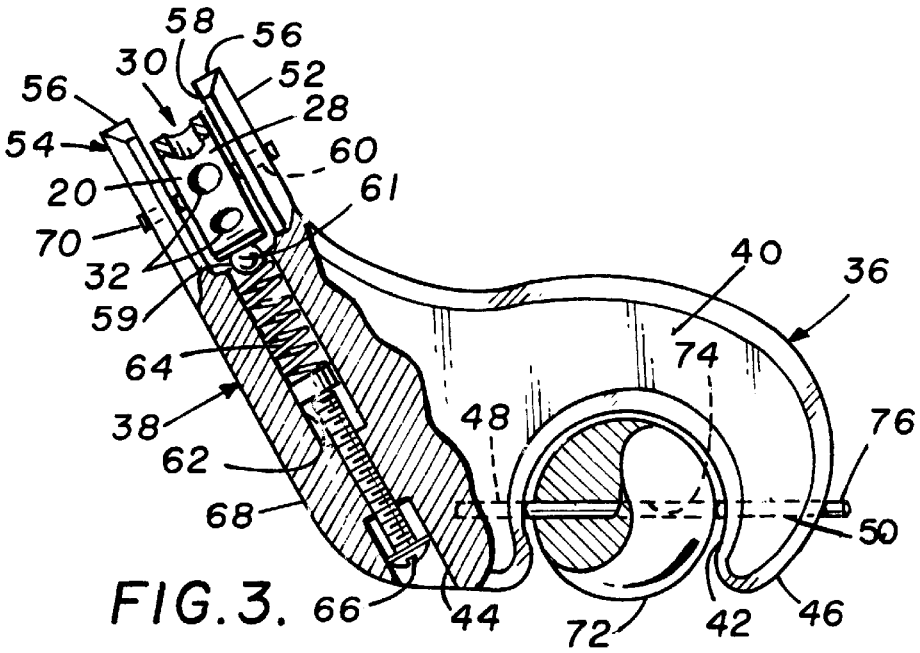
FIG. 3 is a front elevational, partially broken away and in cross section, view of the club head and clicker cylinder incorporated in the golf swing training club of the present invention.
Figure 4:
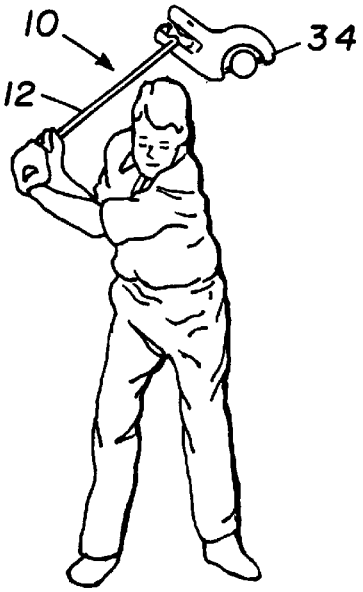
FIG. 4 is a front elevational view of a right handed golfer using the golf swing training club of the present invention in an improper swing in which the club breaks down to indicate the improper swing.
Figure 5:
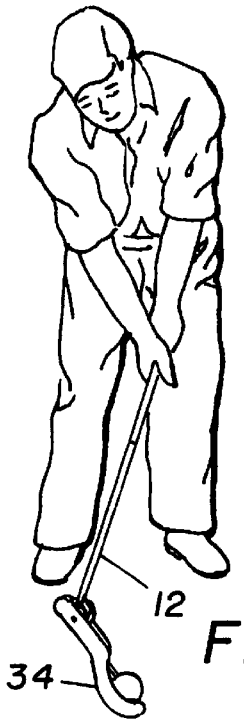
FIG. 5 is a front elevational view of a right handed golfer using the golf swing training club of the present invention wherein the club breaks down due to erratic or non-smooth movement of the club head away from the target area.
Figure 6:
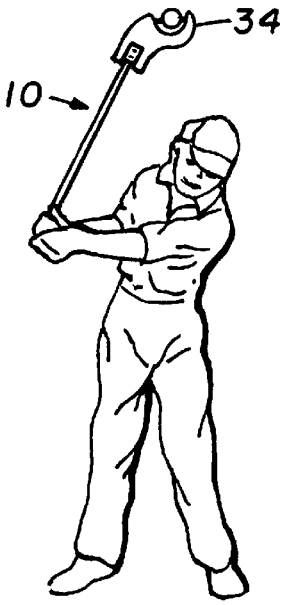
FIG. 6 is a front elevational view of a right handed golfer using the golf swing training club of the present invention at the end of the back swing of the club wherein the golf club does not break down to indicate an improper swing.
Figure 7:
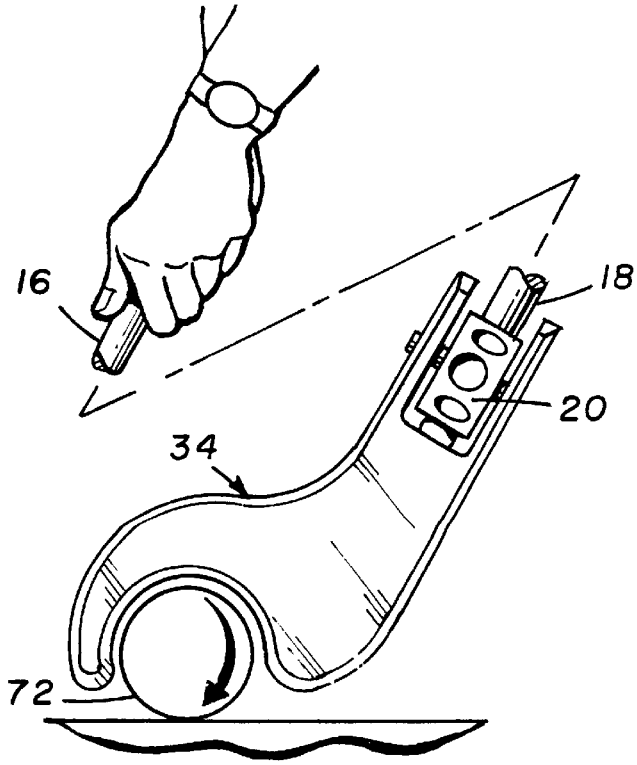
FIG. 7 is a front elevational view, partially broken away, view of a right handed golfer using the golf swing training club of the present invention with the club head at its lowermost position.

Referring now to the drawings, particularly FIGS. 1 and 6 thereof, reference numeral 10 generally designates the golf swing training club of the present invention. As best seen in FIG. 2, training club 10 generally comprises a shaft 12, a cylinder or clicker 20, and a head 34. As best seen in FIG. 2, shaft 12 has an upper end 14 with a conventional golf club grip covering 16 and a lower end 18. As best seen in FIGS. 2 and 3, the cylinder or clicker 20 has a pair of parallel sides (unnumbered), a central bore (unnumbered) extending therethrough which terminate at the parallel sides 22, and a generally round outer periphery 28. The outer periphery 28 of cylinder or clicker 20 has a radial bore 30 (FIG. 3) therein for receiving the lower end 18 of shaft 12, and a plurality of recesses or dimples 32 spaced evenly around its outer periphery 28.

As best seen in FIG. 3, the head 34 is generally L-shaped and has a generally outwardly extending base portion 36, a generally upwardly extending leg portion 38, and two generally parallel sides 40. As best seen in FIG. 3, the outwardly extending base portion 36 of head 34 has a cutout 42 therein which is partially surrounded by a first side member 44 and a second side member 46. The first side member 44 has a bore 48 therein in alignment with a bore 50 in second side member 46 for purposes to be later explained. The generally upwardly extending leg portion 38 of the head 34 has an upper portion 52 in the form of a yoke 54 having a pair of generally parallel side arms 56 which provides a gap 58 therebetween. The bottom (unnumbered) of the gap 58 has a recess 59 therein for purposes to be explained. Each side arm 56 has a bore 60, each of which is axially aligned for purposes to be later explained. The leg portion 38 of the head 34 further includes a bore 62 extending therethrough and intersecting with the bottom of the gap 58 and recess 59 forming a part of the yoke 54. As best seen in FIG. 3, a coiled spring 64 is mounted within the bore 62, and a tension adjusting screw 66 is mounted in the lower end 68 of the leg portion 38. As best seen in FIG. 3, a small ball 61 is positioned within the recess 59 formed in the bottom of the yoke 54 and is acted upon by the coiled spring 64 which urges the small ball 61 into one of the dimples 33 in the periphery 28 of clicker cylinder 20.

The various components of the golf swing training club 10 is assembled as follows. The lower end 18 of the shaft 12 is inserted into the radial bore 30 of the cylinder or clicker 20 and secured to the cylinder or clicker 20 by any suitable means such as an epoxy or adhesive. The cylinder or clicker 20 is placed within the gap 58 of the yoke 54 of the leg portion 38 of the head 34 until the central bore (unnumbered) of the cylinder or clicker 20 is in alignment with the bores 60 in the side arms 56 of the yoke 54, at which time a pin 70 is inserted through the bores 24 and 60 and secured to the walls of the bores 60 by any suitable means such as epoxy or an adhesive. A roller or ball 72 having a central opening 74 therethrough is placed on a pin 76 and the pin 76 is secured to the walls of the bores 48 and 50 in the first and second side members 44 and 46 so that the roller or ball 72 will freely rotate within the cutout 42.

As should be apparent, if there is a smooth proper swing of the training club 10, the club 10 will not break down by a separation of the spring biased ball 61 from a dimple 33 within the outer periphery 28 of the clicker cylinder 20. If the training club 10 during practice detects a swing error such as a movement of the club too fast at the beginning of the backswing, improper timing of the wrist action, incorrect swing path, or jerky movement at any part of the swing, such swing error will cause the training club 10 to break down to provide an immediate indication to the golfer of the swing error. With practice, the golfer is able to diagnose the nature of the error to enable the golfer to correct his swing pattern.

The foregoing is provided for purposes of illustration, explanation and description of the preferred embodiment of the present invention. Modifications, variations and adaptions of the preferred embodiment of the invention will be apparent to those of ordinary skill in the art and they may be made without departing from the scope or spirit of the invention. For example, the cutout 401 in the club head 34 could be other than that shown in the drawings. Furthermore, a roller in the configuration of a cylinder could be substituted for the round ball 72.

I claim:

1. A golf swing training club comprising:

an elongated shaft including an upper end portion having a grip cover secured thereto and a lower end portion;

a clicker cylinder including an outer periphery having a single bore therein for securely receiving said lower end portion of said elongated shaft, and a plurality of spaced dimples therein;

a club head including an outwardly extending base portion, an upwardly extending leg portion, and roller means, said outwardly extending base portion having a cutout therein defining first and second side sections, and means for rotatably mounting said roller means in said cutout between said first and second side sections, said upwardly extending leg portion including an upper section having yoke means therein for defining a gap for receiving said clicker cylinder, a lower section, a bore extending between said lower section and said upper section of said upwardly extending leg portion, and biasing means within said bore in said upwardly extending leg portion for engaging said outer periphery of said clicker cylinder.

2. The golf swing training club of claim 1 wherein said roller means is a round ball of a diameter substantially the same as that of a regular golf ball.

3. The golf swing training club of claim 2 wherein said round ball allows a golfer to practice keeping his head down and his eyes on a target point.

4. The golf swing training club of claim 3 wherein said means for rotatably mounting said round ball includes a pin extending through an opening in said round ball and being secured to each of said first and second side sections which defines said cutout in said outwardly extending base portions.

5. The golf swing training club of claim 4 wherein said biasing means includes a coiled spring mounted within said bore in said upwardly extending leg portion of said club head.

6. The golf swing training club of claim 5 wherein said biasing means further includes a ball for engaging the selected clicker cylinder.

7. The golf swing training club of claim 6 wherein said biasing means further includes means for adjusting the tension in said coiled spring.

8. The golf swing training club of claim 7 wherein said means for adjusting the tension in said coiled spring includes an externally threaded screw mounted in said lower section of said upwardly extending leg portion.

9. The golf swing training club of claim 8 wherein said clicker cylinder allows said club head to break down during an erratic, non-smooth, swing of the training club.

10. The golf swing training club of claim 1 wherein said training club can be used by both right handed and left handed golfers.

11. A golf swing training club comprising:

an elongated shaft including an upper end portion having a grip cover secured thereto and a lower end portion;

a clicker cylinder including an outer periphery having a single bore therein for securely receiving said lower end portion of said elongated shaft, and a plurality of spaced dimples therein;

a club head including an outwardly extending base portion, an upwardly extending leg portion, and roller means, said outwardly extending base portion having a cutout therein defining first and second side sections, and means for rotatably mounting said roller means in said cutout between said first and second side sections, said upwardly extending leg portion including an upper section having yoke means therein for defining a gap for receiving said clicker cylinder, a lower section, a bore extending between said lower section and said upper section of said upwardly extending leg portion, and biasing means within said bore in said upwardly extending leg portion, said biasing means including a coiled spring mounted within said bore in said upwardly extending leg portion of said club head, a ball for releasably engaging selected ones of said dimples in said clicker cylinder whereby said ball may disengage itself from a said selected one of said dimples and cause the club head to break down during an erratic, non-smooth, swing of the training club.

12. The golf swing training club of claim 11 wherein said roller means is a round ball of a diameter substantially the same as that of a regular golf ball.

13. The golf swing training club of claim 12 wherein said round ball allows a golfer to practice keeping his head down and his eyes on a target point.

14. The golf swing training club of claim 13 wherein said means for rotatably mounting said round ball includes a pin extending through an opening in said round ball and being secured to each of said first and second side sections which defines said cutout in said outwardly extending base portions.

15. The golf swing training club of claim 14 wherein said biasing means further includes means for adjusting the tension in said coiled spring.

16. The golf swing training club of claim 15 wherein said means for adjusting the tension in said coiled spring includes an externally threaded screw mounted in said lower section of said upwardly extending leg portion.

17. The golf swing training club of claim 11 wherein said training club can be used by both right handed and left handed golfers.

* * * * *